US012359832B2

(12) United States Patent
Kandhi et al.

(10) Patent No.: US 12,359,832 B2
(45) Date of Patent: Jul. 15, 2025

(54) METHOD AND A SYSTEM TO MAP A CORRECT DAMPER AND SENSOR ASSOCIATION

(71) Applicant: Carrier Corporation, Palm Beach Gardens, FL (US)

(72) Inventors: Ravi Kumar Kandhi, Telangana (IN); Ramesh Babu, Telangana (IN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 697 days.

(21) Appl. No.: 17/695,002

(22) Filed: Mar. 15, 2022

(65) Prior Publication Data

US 2022/0290889 A1 Sep. 15, 2022

(30) Foreign Application Priority Data

Mar. 15, 2021 (IN) ..... 202111010853

(51) Int. Cl.
*F24F 11/63* (2018.01)

(52) U.S. Cl.
CPC ..... *F24F 11/63* (2018.01)

(58) Field of Classification Search
CPC ..... F24F 11/63; F24F 2110/00; F24F 11/52; F24F 11/72
See application file for complete search history.

(56) References Cited

U.S. PATENT DOCUMENTS 5,602,758 A * 2/1997 Lincoln ..... F24F 11/56 236/47
2008/0231437 A1* 9/2008 Singhal ..... F24F 11/30 340/514
2019/0353377 A1* 11/2019 Mao ..... F24F 11/79
2022/0138492 A1* 5/2022 Paulson ..... G06F 16/219

* cited by examiner

*Primary Examiner* — Zhipeng Wang

(74) *Attorney, Agent, or Firm* — CANTOR COLBURN LLP

(57) ABSTRACT

A system and a method for correctly associating damper/s with sensor/s installed in a building. A method includes transmitting one or more commands to one or more dampers associated with one or more zones for controlling a parameter in each zone. The method also includes receiving parameter values for each of the zones sensed by a respective sensor located in an associated zone and determining whether the parameter values received from the respective sensor correspond to the associated zone. The method further includes determining an incorrect damper and sensor association if at least one of the parameter values do not correspond to the associated zone and logically mapping a correct damper and sensor association for each of the zones.

18 Claims, 3 Drawing Sheets

METHOD AND A SYSTEM TO MAP A CORRECT DAMPER AND SENSOR ASSOCIATION

FOREIGN PRIORITY

This application claims priority to Indian Patent Application No. 202111010853, filed Mar. 15, 2021, and all the benefits accruing therefrom under 35 U.S.C. § 119, the contents of which in its entirety are herein incorporated by reference.

TECHNICAL FIELD OF INVENTION

The present invention generally relates to heating, ventilation, and air conditioning (HVAC) systems. More particularly, the invention relates to a system and a method for correctly associating damper/s with sensor/s installed in a building.

BACKGROUND OF THE INVENTION

Dampers are installed in various zones (such as rooms) in a building to control the supply of conditioned air to each zone. In order to measure temperature of the conditioned air supplied by a damper in each zone, a sensor is installed in each of the zones. The damper of each zone is connected through a zone board to a corresponding sensor installed in the same zone. During installation, the sensors and dampers are hard-wired to each other through the zone board by a technician.

After the installation, each connection between the dampers and their corresponding sensor of each zone is assessed through a control system present inside the building. For this, the damper is generally operated in an open position to maintain a particular temperature in each zone by providing a command from the control system. The temperature in each zone is sensed by the corresponding sensor installed in each zone. The sensor then communicates sensed temperature to the control system which determines if the sensed temperature maintained in each zone is the same, or approximate, to the particular temperature for which the control system has provided the command. If not, then the control system determines if the dampers and the corresponding sensor are not matched or are incorrectly connected. This could be due to wrong wiring connections done by the technician between the damper and the sensor. In this situation, the technician has to manually do re-wiring or change the connections between the dampers and the sensor. After changing the connection, the technician has to again assess the changed connection by repeating the entire process explained above. Thus, such assessment or checking of the connection between the dampers and the sensor is tedious in nature, is time-consuming and is a manual task.

In view of the afore-mentioned problems, there is a need of an effective and efficient system and a method for automatically determining an incorrect connection or association between a damper and a sensor and logically mapping a correct damper and sensor association without changing the wire connections. There is also a requirement to eliminate the need of a technician to correct the incorrect wired connection between the damper and the sensor. In order to solve the problems in the existing solutions, a system and a method are disclosed.

SUMMARY OF THE INVENTION

Various embodiments of the invention describe a method for correctly associating damper/s with sensor/s installed in a building. The method comprises the step of transmitting one or more commands to one or more dampers associated with one or more zones for controlling a parameter in each zone. The method further comprises the steps of receiving parameter values for each of the zones sensed by a respective sensor located in an associated zone and determining whether the parameter values received from the respective sensor correspond to the associated zone. The method also comprises the steps of determining an incorrect damper and sensor association if at least one of the parameter values do not correspond to the associated zone and logically mapping a correct damper and sensor association for each of the zones.

In an embodiment of the invention, the correct damper and sensor association is performed without changing physical connections between the dampers and the respective sensors.

In a different embodiment of the invention, the incorrect damper and sensor association occurs during installation while providing physical connections between the dampers and the respective sensors.

In an embodiment of the invention, the one or more zones, each having the damper and sensor association, are located in a building.

In another embodiment of the invention, a notification is transmitted to a user device regarding the incorrect damper and sensor association.

In yet another embodiment of the invention, the parameter is an atmospheric condition of each zone.

In another embodiment of the invention, a thermostat communicates with the dampers and the respective sensors through a wireless connection or a wired connection.

In still another embodiment of the invention, the thermostat displays the incorrect damper and sensor association on a display.

In a different embodiment of the invention, the one or more dampers operate in an open position and a close position to control the parameter.

In yet another embodiment of the invention, each zone has a damper associated with a sensor.

Various embodiments of the invention describe a system for correctly associating damper/s with sensor/s installed in a building. The server comprises a receiver, a transmitter, a determination unit and a mapping unit. The transmitter is adapted to transmit one or more commands to one or more dampers associated with one or more zones for controlling a parameter in each zone. The receiver is adapted to receive parameter values for each of the zones sensed by a respective sensor located in an associated zone. The determination unit is adapted to determine whether the parameter values received from the respective sensor correspond to the associated zone and to determine an incorrect damper and sensor association if at least one of the parameter values do not correspond to the associated zone. The mapping unit is adapted to logically map a correct damper and sensor association for each of the zones.

In a different embodiment of the invention, the correct damper and sensor association is performed without changing physical connections between the dampers and the respective sensor.

In yet another embodiment of the invention, the incorrect damper and sensor association occurs during installation while providing physical connections between the dampers and the respective sensor.

In an embodiment of the invention, the one or more zones, each having the damper and sensor association, are located in a building.

In yet another embodiment of the invention, the transmitter is further adapted to transmit a notification to a user device regarding the incorrect damper and sensor association.

In another embodiment of the invention, the parameter is an atmospheric condition of each zone.

In a different embodiment of the invention, a thermostat communicates with the dampers and the respective sensor through a wireless connection or a wired connection.

In yet another embodiment of the invention, the thermostat displays the incorrect damper and sensor association on a display.

In an embodiment of the invention, the one or more dampers operate in an open position and a close position to control the parameter.

In another different embodiment of the invention, a computer readable medium is disclosed for correctly associating damper/s with sensor/s installed in a building. The computer readable medium comprises one or more processors and a memory is coupled to the one or more processors, the memory stores instructions executed by the one or more processors. The one or more processors are configured to transmit one or more commands to one or more dampers associated with one or more zones for controlling a parameter in each zone. The one or more processors are further configured to receive parameter values for each of the zones sensed by a respective sensor located in an associated zone and determine whether the parameter values received from the respective sensor correspond to the associated zone. The one or more processors are also configured to determine an incorrect damper and sensor association if at least one of the parameter values do not correspond to the associated zone and logically map a correct damper and sensor association for each of the zones.

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

Other aspects, advantages, and salient features of the invention will become apparent to those skilled in the art from the following detailed description, which taken in conjunction with the annexed drawings, discloses exemplary embodiments of the invention.

BRIEF DESCRIPTION OF THE DRAWINGS

Corresponding reference numerals indicate corresponding parts throughout the drawings.

DETAILED DESCRIPTION OF THE INVENTION

Described herein is a technology with a system and a method for correctly associating damper/s with sensor/s installed in a building. The building may have one or more zones such as rooms and a thermostat may be installed in any of the zones or anywhere inside the building. Further, a damper and a respective sensor may be associated with each zone. Further, the thermostat may provide a command to each of the damper installed in each zone to operate in an open position so that the air may be supplied to the associated zone. The command may be provided to control a parameter in each zone. The respective sensors located in the associated zones may sense the parameter and may also transmit sensed parameter values to the thermostat.

On receiving the parameter values, the thermostat may determine whether the parameter values received from the respective sensors correspond to the associated zone or not. And, if any of the parameter values do not correspond to the associated zone, then the thermostat may determine an incorrect damper and sensor association. Moreover, the thermostat may also logically map a correct damper and sensor association for each of the zones based on the determination of the incorrect damper and sensor association.

As used herein, the thermostat may be a device configured to receive command from a user for controlling the parameter in each zone. The thermostat may also be configured to communicate with each of the sensor/s and the damper/s via zone boards through wired connections and/or wireless connections. The functionalities of the thermostat has been described below in greater detail.

As used herein, the damper may be located in each zone and are connected with sensor/s and thermostat via zone boards through wired connections and/or wireless connections. Each damper may have a respective sensor.

As used herein, the sensor located in each zone may be a sensor configured to sense a parameter. The sensor may include, but is not limited to, a temperature sensor, a humidity sensor or any other sensor that is well known in the art. As used herein, the parameter may be an atmospheric condition of each zone such as temperature, a humidity or any such parameter that is well known in the art.

Figure 1:
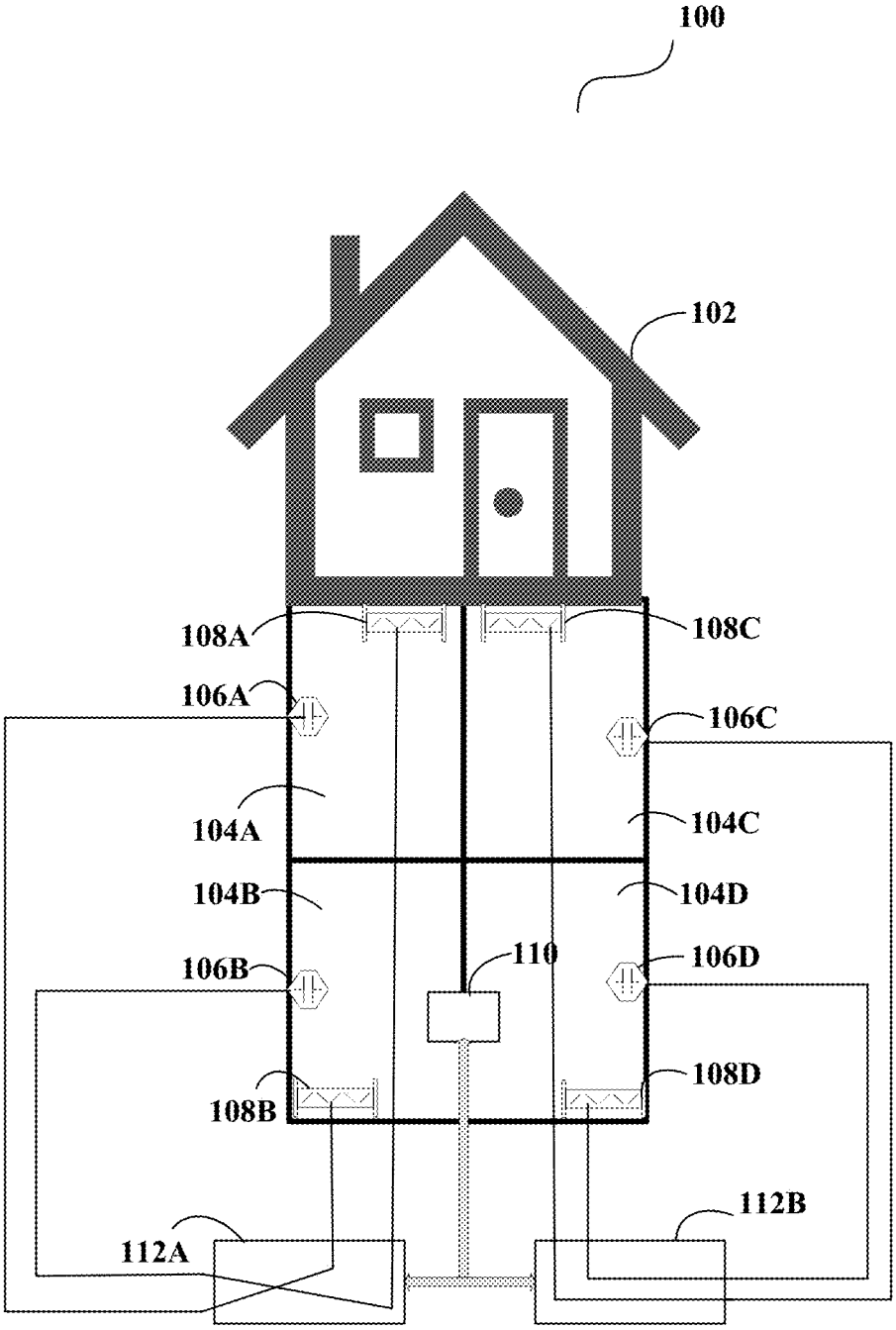
FIG. 1 depicts an exemplary system architecture according to an exemplary embodiment of the invention.

FIG. 1 depicts an exemplary system architecture 100 according to an exemplary embodiment of the invention. As depicted in FIG. 1, a building 102 may include one or more zones, namely a first zone 104A, a second zone 104B, a third zone 104C and a fourth zone 104D. Further, each zone 104A-104D may have a respective damper and a respective sensor associated therewith. That is, a first damper 108A installed in the first zone 104A and a first sensor 106A located in the first zone 104A may be associated with the first zone 104A. In the same way, a second damper 108B installed in the second zone 104B and a second sensor 106B located in the second zone 104B may be associated with the second zone 104B. Also, a third damper 108C installed in the third zone 104C and a third sensor 106C located in the third zone 104C may be associated with the third zone 104C. And, a fourth damper 108D installed in the fourth zone 104D and a fourth sensor 106D located in the fourth zone 104D may be associated with the fourth zone 104D.

Also depicted in FIG. 1 is a first zone board 112A which connects the first damper 108A installed in the first zone 104A with the second sensor 106B located in the second zone 104B and also connects the second damper 108B installed in the second zone 104B with the first sensor 106A located in the first zone 104A. It can be seen here that the first damper 108A installed in the first zone 104A is incorrectly connected or associated (through wires) with the second sensor 106B located in the second zone 104B. It can be further seen here that the second damper 108B installed in the second zone 104B is incorrectly connected or associated (through wires) with the first sensor 106A located in the first zone 104A. This incorrect connections or associations of a damper with a sensor is generally a result of a manual error done by a technician who has wrongly hard-wired the damper with the sensor during installation while providing physical connections between the dampers 108A-108B and the respective sensors 106A-106B.

Furthermore, a second zone board 112B is also shown in FIG. 1 which connects the third damper 108C with the third sensor 106C located in the third zone 104C and the fourth damper 108D with the fourth sensor 106D located in the fourth zone 104D. It can be seen here that the third damper 108C is correctly connected or associated with the third respective sensor 106C and the fourth damper 108D is also correctly connected or associated with the fourth respective sensor 106D.

Moreover, a thermostat 110 can be installed in any of the zones 104A-104D and may also be installed outside the zones 104A-104D such as a basement or a backyard of the building 102. As depicted, the thermostat 110 may be connected to the dampers 108A-108D and the sensors 106A-106D via the first zone board 112A and the second zone board 112B through wire connections and/or wireless connections. Further, the dampers 108A-108D may be operated in an open position or in a closed position. In the closed position, a damper stops the supply of the air in an associated zone. In the open position, the damper supplies the air in the associated zone.

Once the thermostat 110, the dampers 108A-108D and the sensors 106A-106D are installed in the building 102, the thermostat 110 may transmit a command via the zone boards 112A/112B to each of the dampers 108A-108D associated with each zone 104A-104D. The command/s may be transmitted through wired and/or wireless connections for controlling a parameter (i.e. an atmospheric condition of each zone such as temperature, a humidity etc.) in each zone 104A-104D. In an exemplary embodiment, the command may be generated and transmitted by the thermostat 110 when a personnel (not shown) inputs a parameter value in a display/interface of the thermostat 110 for controlling the parameter in each of the zones 104A-104D. For instance, the personnel may input a temperature value of 3° Celsius (i.e. parameter value) at the interface to maintain the temperature of 3° Celsius in the first zone 104A. In another instance, the personnel may input a temperature value of 35° Celsius at the interface to maintain the temperature of 35° Celsius in the second zone 104B and may also input a temperature value of 25° Celsius at the interface to maintain the temperature of 25° Celsius in the third zone 104C. For example, the personnel may input a temperature value of 15° Celsius at the interface to maintain the temperature of 15° Celsius in the fourth zone 104D.

The dampers 108A-108D, on receiving the command from the thermostat 110 via the zone boards 112A/112B, may operate in the open position. In an exemplary embodiment, the dampers 108A-108D may be partially open or a fully open based on the requirement of the controlling the parameter in the particular zone 104A-104D. It is understood for a person skilled in the art that depending upon the partial opening or the full opening of the dampers 108A-108D, the cooling or heating in the zones 104A-104D may be controlled.

After a period of time when the damper 108A-108D operates in the open position, the first sensor 106A associated with the first zone 104A may sense the controlled parameter therein and may also transmit a parameter value for the first zone 104A to the thermostat 110. Similarly, the second sensor 106B associated with the second zone 104B may sense the controlled parameter therein and may also transmit a parameter value for the second zone 104B to the thermostat 110. Also, the third sensor 106C associated with the third zone 104C may sense the controlled parameter therein and may also transmit a parameter value for the third zone 104C to the thermostat 110. And, the fourth sensor 106D associated with the fourth zone 104D may sense the controlled parameter therein and may also transmit a parameter value for the fourth zone 104D to the thermostat 110.

However, as explained above, the first damper 108A is incorrectly connected or associated with the second sensor 106B and the second damper 108B is incorrectly connected or associated with the first sensor 106A. Due to these incorrect damper and sensor connections or associations, the first sensor 106A may sense the controlled parameter of the second zone 104B and transmit the sensed parameter value associated with the second zone 104B to the thermostat 110. Similarly, the second sensor 106B may sense the controlled parameter of the first zone 104A and transmit the sensed parameter value associated with the first zone 104A to the thermostat 110. Consider an example where the first sensor 106A transmit the sensed parameter value i.e. 34.5° Celsius associated with the second zone 104B and the second sensor 106B transmit the sensed parameter value i.e. 3.1° Celsius associated with the first zone 104A. Furthermore, the third sensor 106C transmit the sensed parameter value i.e. 24.5° Celsius associated with the third zone 104C and the fourth sensor 106D transmits the sensed parameter value i.e. 15.1° Celsius associated with the fourth zone 104D.

On receiving the sensed parameter value from each of the sensors 106A-106D, the thermostat 110 may determine whether the parameter values received from the sensors 106A-106D correspond to the associated zones 104A-104D or not. For this, the thermostat 110 may compare the inputted parameter value by the personnel at the thermostat 110 sent as a command with the sensed parameter value received from each of the sensors 106A-106D. An exemplary Table 1 is provided herein below to elucidate this determination for ease of understanding.

TABLE 1

| Inputted parameter value by personnel | Inputted parameter value for zone | Sensed parameter value from sensor | Sensor sensed parameter value |
|---|---|---|---|
| 3° Celsius | First zone 104A | 34.5° Celsius | 106A |
| 35° Celsius | Second zone 104B | 3.1° Celsius | 106B |
| 25° Celsius | Third zone 104C | 24.5° Celsius | 106C |
| 15° Celsius | Fourth zone 104A | 15.1° Celsius | 106D |

From the exemplary Table 1 above, the thermostat 110 may determine that the parameter (i.e. temperature) sensed by the third sensor 106C and the fourth sensor 106D are almost same as expected. That is, the inputted parameter value/s (i.e. 25° Celsius for the third zone 104C and 15° Celsius for the fourth zone 104D) by the personnel is approximate to the sensed parameter value (i.e. 24.5° Celsius for the third zone 104C and 15.1° Celsius for the fourth zone 104D). Thus, the thermostat 110 may determine that the third sensor 106C corresponds to the third zone 104C and the fourth sensor 106D correspond to the fourth zone 104D. Thereby, in this case, the thermostat 110 may determine a correct third damper 108C and third sensor 106C association when the parameter value (i.e. 24.5° Celsius) correspond to the associated third zone 104C and a correct fourth damper 108D and fourth sensor 106D association when the parameter value (i.e. 15.1° Celsius) correspond to the associated fourth zone 104D.

Still referring to the exemplary Table 1 above, the thermostat 110 may determine that the parameter (i.e. temperature) sensed by the first sensor 106A and the second sensor 106B are not the same as what is expected. This anomaly is determined as the inputted parameter value/s (i.e. 3° Celsius for the first zone 104A and 35° Celsius for the second zone 104B) by the personnel is different from the sensed parameter value (i.e. 34.5° Celsius for the first zone 104A and 3.1° Celsius for the second zone 104B) received from the first sensor 106A and the second sensor 106A. Thus, the thermostat 110 may determine that the first sensor 106A does not correspond to the first zone 104A and the second sensor 106B does not correspond to the second zone 104B. Thereby, in this case, the thermostat 110 may determine an incorrect first damper 108A and second sensor 106B association when the parameter value (i.e. 3.1° Celsius) sensed by the second sensor 106B does not correspond to the associated first zone 104A and an incorrect second damper 108B and first sensor 106A association when the parameter value (i.e. 34.5° Celsius) sensed by the first sensor 106A does not correspond to the associated second zone 104B.

Now, the thermostat 110 may logically map a correct damper and sensor association for each of the zones 104A-104D. On determining the incorrect first damper 108A and second sensor 106B association and the incorrect second damper 108B and first sensor 106A association, the thermostat 110 knows that the first damper 108A is incorrectly physically wired with the second sensor 106B and the second damper 108B is incorrectly physically wired with the first sensor 106A. By this determination, the thermostat 110 may start logically associating/linking the first damper 108A with the second sensor 106B for the first zone 104A and the second damper 108B associating/linking with the first sensor 106A for the second zone 104B. Such logically associating/linking may be updated in a memory of the thermostat 110. On logically mapping the correct damper and sensor association for each of the zones 104A-104B, the thermostat 110 may always logically link the sensed parameter value received from the first sensor 106A with the second zone 104B and the sensed parameter value received from the second sensor 106B with the first zone 104A. Thereby, the logically mapping of the correct damper and sensor association for each of the zones 104A-104D can be achieved without changing physical connections/wires between the dampers 108A-108B and the sensors 106A-106B. As a result, the thermostat 110 may also accordingly associate sensed temperature with a respective sensor and a zone based on logically mapping of the correct damper and sensor association for each of the zones 104A-104D.

The present invention further encompasses the thermostat 110 to display on its interface the incorrect damper and sensor association and/or logically mapping of the correct damper and sensor association for each of the zones 104A-104D. The present invention further encompasses the thermostat 110 to transmit a notification to a user device (not shown) through a network regarding the incorrect damper and sensor association and/or a notification regarding logically mapping of the correct damper and sensor association for each of the zones 104A-104D. The user device may belong to a person who may be an owner of the building 102 or a technician who has physically wired the damper/s 108A-108D with the sensor 106A-106D. Through these notification/s, the person may always be informed about the incorrect damper and sensor association and a logical mapping of a correct damper and sensor association which is currently being used by the thermostat 110. By this, the person may not have to physically inspect or manually check the damper and sensor association. This also reduces time invested by the person on determining the incorrect damper and sensor association and the logical mapping of a correct damper and sensor association.

Figure 2:
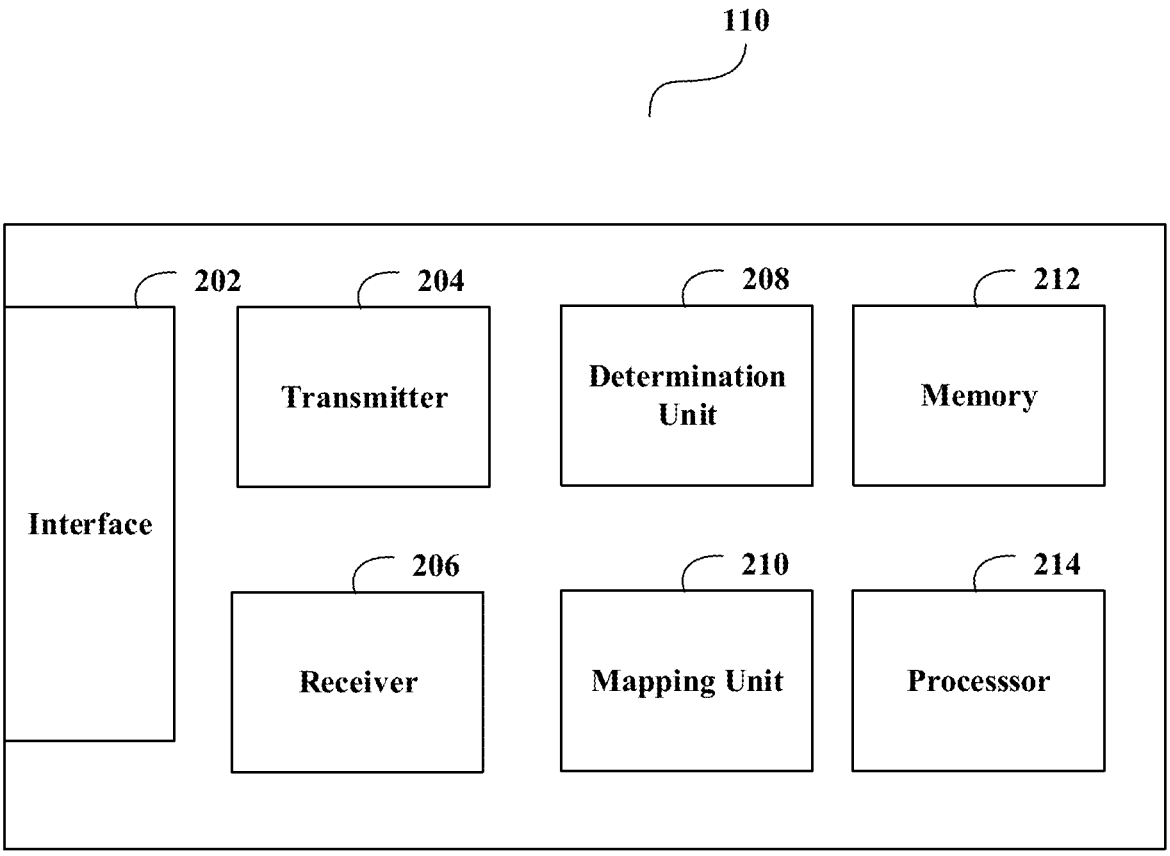
FIG. 2 depicts block diagram of different components of an exemplary thermostat according to an exemplary embodiment of the invention.

FIG. 2 depicts block diagram of different components of a thermostat 110 according to an exemplary embodiment of the invention. The thermostat 110 may comprise of, but is not limited to, an interface/display 202, a transmitter 204, a receiver 206, a determination unit 208, a mapping unit 210, a memory 212, and/or a processor 214. The interface/display 202 may be adapted to receive a parameter input from a personnel for operating a parameter in each zones 104A-104D. The transmitter 204 may be adapted to transmit command/s to one or more dampers 108A-108D associated with one or more zones 104A-104D for controlling the parameter in each zone 104A-104D as explained above. The receiver 206 may be adapted to receive parameter values for each of the zones 104A-104D sensed by a sensor 106A-106D located in an associated zone. The sensor and zone association has been explained in details above in FIG. 1. The receiver 206 may communicate the parameter values to the determination unit 208 which is adapted to determine whether the parameter values received from the sensor 106A-106D correspond to the associated zone 104A-104D. The determination unit 208 may also be adapted to determine an incorrect damper and sensor association if at least one of the parameter values do not correspond to the associated zone 104A-104D. The determination of whether the parameter values correspond to the associated zone, the incorrect damper and sensor association has been explained in details above in FIG. 1. The determination unit 208 may communicate the incorrect damper and sensor association to the mapping unit 210. The mapping unit 210 may be adapted to logically map a correct damper and sensor association for each of the zones 104A-104D which has been explained above in FIG. 1.

Further, the interface/display 202 may further be adapted to display the incorrect damper and sensor association and/or the logically mapping of a correct damper and sensor association for each of the zones 104A-104D. And, the transmitter 204 may also be adapted to transmit notification to a user device regarding the incorrect damper and sensor association and/or the logically mapping of a correct damper and sensor association for each of the zones 104A-104D. The memory 212 may be adapted to store the determination of the incorrect damper and sensor association and/or the logically mapping of a correct damper and sensor association for each of the zones 104A-104D. The processor 214 may be adapted to communicably coupled with the determination unit 208 and the mapping unit 210 for performing the operations such as comparison of inputted parameter value with sensed parameter value received from each of the sensors 106A-106D and logical mapping as explained above.

Moreover, the interface/display 202, the transmitter 204, the receiver 206, the determination unit 208, the mapping unit 210, and/or the memory 212 may be communicably coupled with the processor 214. The different units described herein are exemplary. The invention may be performed using one or more units. For example, the tasks executed by the interface/display 202, the transmitter 204, the receiver 206, the determination unit 208, the mapping unit 210, the memory 212 and/or the processor 214 may be performed by a single unit. Alternatively, more number of units as described herein may be used to perform the present invention.

Figure 3:
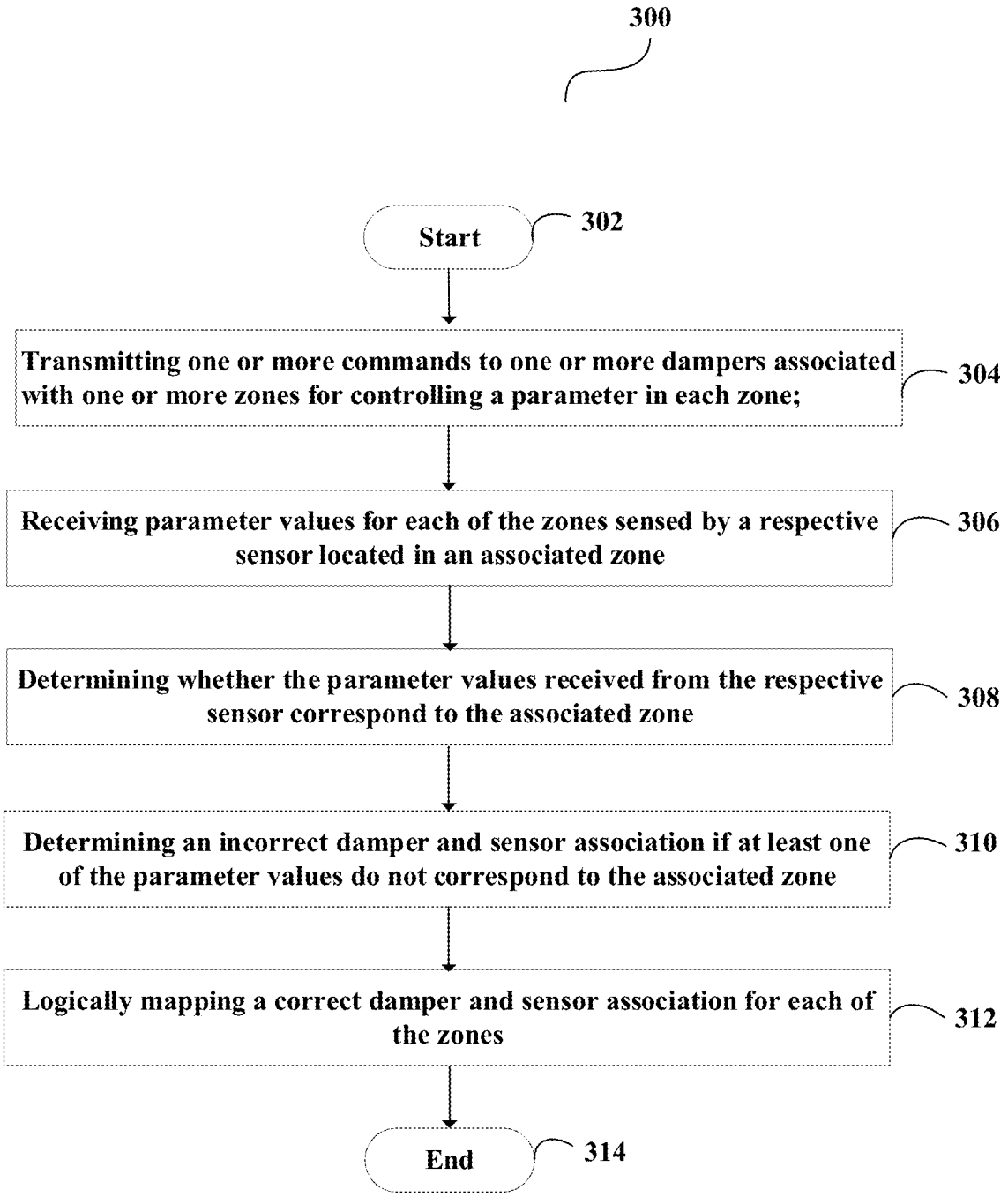
FIG. 3 depicts an exemplary flowchart illustrating a method to perform the invention according to an exemplary embodiment of the invention.

FIG. 3 depicts a flowchart outlining the features of the invention in an exemplary embodiment of the invention. The method flowchart 300 describes a method for correctly associating damper/s with sensor/s installed in a building 102. The method flowchart 300 starts at step 302.

At step 304, a thermostat 110 may transmit one or more commands to one or more dampers 108A-108D associated with one or more zones 104A-104D for controlling a parameter in each zone 104A-104D. This has been discussed in greater details in FIG. 1 above.

At step 306, the thermostat 110 may receive parameter values for each of the zones 104A-104D sensed by a respective sensor 106A-106D located in an associated zone 104A-104D. This has been discussed in greater details in FIG. 1 above.

At step 308, the thermostat 110 may determine whether the parameter values received from the respective sensor 106A-106D correspond to the associated zone 104A-104D. This has been discussed in greater details in FIG. 1 above.

At step 310, the thermostat 110 may determine an incorrect damper and sensor association if at least one of the parameter values do not correspond to the associated zone 104A-104D. This has been discussed in greater details in FIG. 1 above.

At step 312, the thermostat 110 may logically map a correct damper and sensor association for each of the zones 104A-104D. This has been discussed in greater details in FIG. 1 above. Then, the method 300 may end at step 314.

In one embodiment of the invention, the invention can be operated using the one or more computer readable devices. The one or more computer readable devices can be associated with a thermostat 110. A computer readable medium comprises one or more processors and a memory coupled to the one or more processors, the memory stores instructions executed by the one or more processors. The one or more processors is configured to transmit one or more commands to one or more dampers 108A-108D associated with one or more zones 104A-104D for controlling a parameter in each zone 104A-104D and receive parameter values for each of the zones 104A-104D sensed by a respective sensor 106A-106D located in an associated zone 104A-104D. The one or more processors is also configured to determine whether the parameter values received from the respective sensor 106A-106D correspond to the associated zone 104A-104D. The one or more processors is also configured to determine an incorrect damper and sensor association if at least one of the parameter values do not correspond to the associated zone 104A-104D and logically map a correct damper and sensor association for each of the zones 104A-104D.

The present invention is applicable in various industries/fields such as offices, schools, malls, homes, hospitals etc. that is well known in the art and where the thermostat 110 are used.

The embodiments of the invention discussed herein are exemplary and various modification and alterations to a person skilled in the art are within the scope of the invention.

Exemplary computer readable media includes flash memory drives, digital versatile discs (DVDs), compact discs (CDs), floppy disks, and tape cassettes. By way of example and not limitation, computer readable media comprise computer storage media and communication media. Computer storage media include volatile and nonvolatile, removable and non-removable media implemented in any method or technology for storage of information such as computer readable instructions, data structures, program modules or other data. Computer storage media are tangible and mutually exclusive to communication media. Computer storage media are implemented in hardware and exclude carrier waves and propagated signals. Computer storage media for purposes of this invention are not signals per se. Exemplary computer storage media include hard disks, flash drives, and other solid-state memory. In contrast, communication media typically embody computer readable instructions, data structures, program modules, or other data in a modulated data signal such as a carrier wave or other transport mechanism and include any information delivery media.

Although described in connection with an exemplary computing system environment, examples of the invention are capable of implementation with numerous other general purpose or special purpose computing system environments, configurations, or devices.

Examples of the invention may be described in the general context of computer-executable instructions, such as program modules, executed by one or more computers or other devices in software, firmware, hardware, or a combination thereof. The computer-executable instructions may be organized into one or more computer-executable components or modules. Generally, program modules include, but are not limited to, routines, programs, objects, components, and data structures that perform particular tasks or implement particular abstract data types. Aspects of the invention may be implemented with any number and organization of such components or modules. For example, aspects of the invention are not limited to the specific computer-executable instructions or the specific components or modules illustrated in the Figures and described herein. Other examples of the invention may include different computer-executable instructions or components having more or less functionality than illustrated and described herein. Aspects of the invention transform a general-purpose computer into a special-purpose computing device when configured to execute the instructions described herein.

The order of execution or performance of the operations in examples of the invention illustrated and described herein is not essential, unless otherwise specified. That is, the operations may be performed in any order, unless otherwise specified, and examples of the invention may include additional or fewer operations than those disclosed herein. For example, it is contemplated that executing or performing a particular operation before, contemporaneously with, or after another operation is within the scope of aspects of the invention.

As it employed in the subject specification, the term "controller" can refer to substantially any processor or computing processing unit or device comprising, but not limited to comprising, a direct digital control of a HVAC system, a zone controller of the HVAC system, single-core processors; single-processors with software multithread execution capability; multi-core processors; multi-core processors with software multithread execution capability; multi-core processors with hardware multithread technology; parallel platforms; and parallel platforms with distributed shared memory. Additionally, a processor can refer to an integrated circuit, an application specific integrated circuit (ASIC), a digital signal processor (DSP), a field programmable gate array (FPGA), a programmable logic controller (PLC), a complex programmable logic device (CPLD), a discrete gate or transistor logic, discrete hardware components, or any combination thereof designed to perform the functions described herein. Processors can exploit nano-scale architectures such as, but not limited to, molecular and quantum-dot based transistors, switches and gates, in order to optimize space usage or enhance performance of user equipment. A processor may also be implemented as a combination of computing processing units.

When introducing elements of aspects of the invention or the examples thereof, the articles "a," "an," "the," and "said" are intended to mean that there are one or more of the elements. The terms "comprising," "including," and "having" are intended to be inclusive and mean that there may be additional elements other than the listed elements. The term "exemplary" is intended to mean "an example of" The phrase "one or more of the following: A, B, and C" means "at least one of A and/or at least one of B and/or at least one of C".

Having described aspects of the invention in detail, it will be apparent that modifications and variations are possible without departing from the scope of aspects of the invention as defined in the appended claims. As various changes could be made in the above constructions, products, and methods without departing from the scope of aspects of the invention, it is intended that all matter contained in the above description and shown in the accompanying drawings shall be interpreted as illustrative and not in a limiting sense.

Although the subject matter has been described in language specific to structural features and/or acts, it is to be understood that the subject matter defined in the appended claims is not necessarily limited to the specific features or acts described above. Rather, the specific features and acts described above are disclosed as examples of implementing the claims and other equivalent features and acts are intended to be within the scope of the claims.

What is claimed is:

1. A method comprising:

transmitting one or more commands to one or more dampers associated with one or more zones for controlling a parameter in each zone;

receiving parameter values for each of the zones sensed by a respective sensor located in an associated zone;

determining whether the parameter values received from the respective sensor correspond to the associated zone;

determining an incorrect damper and sensor association if at least one of the parameter values do not correspond to the associated zone;

logically mapping a correct damper and sensor association for each of the zones;

controlling the one or more dampers to operate in an open position and a closed position in response the logically mapping of the correct damper and sensor association for each of the zones;

wherein the logically mapping the correct damper and sensor association for each of the zones includes mapping a first temperature sensor intended to be in a first zone with a second damper located in a second zone and mapping a second temperature sensor intended to be in the second zone with a first damper located in the first zone.

2. The method of claim 1, wherein the correct damper and sensor association is performed without changing physical connections between the dampers and the respective sensors.

3. The method of claim 1, wherein the incorrect damper and sensor association occurs during installation while providing physical connections between the dampers and the respective sensors.

4. The method of claim 1, wherein the one or more zones, each having the damper and sensor association, are located in a building.

5. The method of claim 1, further comprising, transmitting a notification to a user device regarding the incorrect damper and sensor association.

6. The method of claim 1, wherein the parameter is an atmospheric condition of each zone.

7. The method of claim 1, wherein a thermostat communicates with the dampers and the respective sensors through a wireless connection or a wired connection.

8. The method of claim 7, wherein the thermostat displays the incorrect damper and sensor association on a display.

9. The method of claim 1, wherein each zone has a damper associated with a sensor.

10. A system comprising:

a transmitter adapted to transmit one or more commands to one or more dampers associated with one or more zones for controlling a parameter in each zone;

a receiver adapted to receive parameter values for each of the zones sensed by a respective sensor located in an associated zone;

a processor adapted to:

determine whether the parameter values received from the respective sensor correspond to the associated zone;

determine an incorrect damper and sensor association if at least one of the parameter values do not correspond to the associated zone; and logically map a correct damper and sensor association for each of the zones;

a thermostat adapted to control the one or more dampers to operate in an open position and a closed position in response the logically mapping of the correct damper and sensor association for each of the zones;

wherein the logically mapping the correct damper and sensor association for each of the zones includes mapping a first temperature sensor intended to be in a first zone with a second damper located in a second zone and mapping a second temperature sensor intended to be in the second zone with a first damper located in the first zone.

11. The system of claim 10, wherein the correct damper and sensor association is performed without changing physical connections between the dampers and the respective sensor.

12. The system of claim 10, wherein the incorrect damper and sensor association occurs during installation while providing physical connections between the dampers and the respective sensor.

13. The system of claim 10, wherein the one or more zones, each having the damper and sensor association, are located in a building.

14. The system of claim 10, wherein the transmitter is further adapted to transmit a notification to a user device regarding the incorrect damper and sensor association.

15. The system of claim 10, wherein the parameter is an atmospheric condition of each zone.

16. The system of claim 10, wherein the thermostat communicates with the dampers and the respective sensor through a wireless connection or a wired connection.

17. The system of claim 16, wherein the thermostat displays the incorrect damper and sensor association on a display.

18. A non-transitory computer readable medium storing instructions executed by one or more processors to:

transmit one or more commands to one or more dampers associated with one or more zones for controlling a parameter in each zone;

receive parameter values for each of the zones sensed by a respective sensor located in an associated zone;

determine whether the parameter values received from the respective sensor correspond to the associated zone;

determine an incorrect damper and sensor association if at least one of the parameter values do not correspond to the associated zone;

logically map a correct damper and sensor association for each of the zones;

control the one or more dampers to operate in an open position and a closed position in response the logically mapping of the correct damper and sensor association for each of the zones;

wherein the logically mapping the correct damper and sensor association for each of the zones includes mapping a first temperature sensor intended to be in a first zone with a second damper located in a second zone and mapping a second temperature sensor intended to be in the second zone with a first damper located in the first zone.

* * * * *